United States Patent [19]

Pay et al.

[11] Patent Number: 4,552,231

[45] Date of Patent: Nov. 12, 1985

[54] ROTATING PILOT CORE BIT FOR USE IN HIGHLY FRACTURED FORMATIONS

[75] Inventors: Clifford R. Pay, Woods Cross, Utah; F. James Thornton, Bakersfield, Calif.

[73] Assignee: Norton Christensen, Inc., Salt Lake City, Utah

[21] Appl. No.: 529,407

[22] Filed: Sep. 6, 1983

[51] Int. Cl.[4] ..... E21B 10/48

[52] U.S. Cl. ..... 175/330; 175/387; 175/403

[58] Field of Search ..... 175/330, 387, 403, 404, 175/405, 410

[56] References Cited

U.S. PATENT DOCUMENTS

| | | | |
|---|---|---|---|
| 1,791,370 | 2/1931 | Oksenholt | 175/387 |
| 1,907,154 | 5/1933 | Mitchell | 175/330 |
| 2,587,231 | 2/1952 | Schierding | 175/387 X |
| 2,862,691 | 12/1958 | Cochran | 175/387 X |
| 3,537,538 | 11/1970 | Generoux | 175/330 |

FOREIGN PATENT DOCUMENTS

| | | | |
|---|---|---|---|
| 659574 | 3/1963 | Canada | 175/410 |
| 1077018 | 5/1980 | Canada | 175/410 |

*Primary Examiner*—James A. Leppink
*Assistant Examiner*—David J. Bagnell
*Attorney, Agent, or Firm*—Beehler, Pavitt, Siegemund, Jagger & Martella

[57] ABSTRACT

Coring samples can be taken in highly fractured rock formations without physical disturbance of the coring sample as it is cut and without jamming the core within the core barrel by using a rotating coring bit characterized by a pilot portion. The pilot portion extends the inner gage to form a longitudinally extending cylindrical surface. The nose of the pilot portion is characterized by a crowned surface wherein cylindrical polycrystalline diamond (PCD) cutting elements are axially disposed and longitudinally extending from the crowned surface. The width of the crowned surface which forms the nose of the pilot portion, is substantially less than the distance between the inner and outer gages of the coring bit. The pilot portion joins a flank portion of the bit through a cylindrical and longitudinally extending pilot gage. The length of the pilot gage is sufficiently long so that the cutting action provided at the nose of the pilot portion is substantially unaffected by the cutting action occurring at the flank portion of the bit.

3 Claims, 4 Drawing Figures

ROTATING PILOT CORE BIT FOR USE IN HIGHLY FRACTURED FORMATIONS

BACKGROUND OF THE INVENTION

1. Field of the Invention

The present invention relates to the field of earth boring tools and more particularly to coring bits utilizing diamond cutting elements.

2. Description of the Prior Art

It is a well established procedure during drilling operations to take a core sample at various levels for both physical and chemical evaluation. Such coring bits are generally characterized by a semi-toroidally shaped drill bit having an inner diameter defining the inner gage with the outer diameter defining the outer gage. In cases where the rock formation being drilled is cohesive or solid, long core samples can be cut and retrieved without difficulty. However, in the case where the rock formation is fractured by a multiplicity of fracture planes or cracks, the grinding action of the rotating drill bit at the bottom of the bore often tends to disturb or mix the core sample as it is cut. As a result, the detailed physical characteristics of the rock formation are lost by the disturbance which is inherently created during the cutting of the core.

Furthermore, as the core is progressively cut, the fracture planes will be shifted as the core moves upwardly within the core barrel. As these planes are shifted or inclined from their original position, each fractured segment of the cut core tends to act like a wedge when displaced from its initial position within the formation. The jumbled wedges bear against the inner surface of the core barrel as the core moves upwardly within the barrel with the result that one or more of the wedges tend to seize and thereby jam the entire core within the barrel. When this occurs, further descent of the coring bit is prevented and all drilling action ceases. Such core jamming can occur at any time and particularly at any point during the coring operation prior to the cutting of the full desired length of the core.

What is needed then is a coring bit, particularly a diamond rotating bit, which has a design which avoids each of these pitfalls of the prior art. In other words, one characteristic of such a design would be a coring bit which does not disturb or which minimally disturbs a core cut from a highly fractured rock formation so that the physical configuration of the cut core within the core barrel is physically identical or substantially identical to the rock formation from which the core was taken. Another characteristic of such an invention would be a coring bit incorporating a design which could be used in a highly fractured formation which left each of the fractured core segments substantially in the same position and orientation as each segment assumed in the original rock formation so that the segments do not become misaligned and wedge against the inner surface of the core barrel, thereby causing a core jam.

BRIEF SUMMARY OF THE INVENTION

The present invention is an improved rotating bit for coring. The bit includes an inner gage which defines the core sample diameter and an outer gage which defines the bore hole diameter. A bit face is provided between the inner and outer gages of the bit and is characterized by a longitudinal axis. The bit comprises a shoulder portion extending from the outer gage. The shoulder portion smoothly joins the outer gage to a flank portion. The flank portion extends across the bit face and joins a pilot portion. The pilot portion is a cylindrical, longitudinally extending surface which forms the lowermost cutting surface of the bit and extends and joins to the inner gage to cut the core sample. The inner and outer gage, shoulder portion, flank portion and pilot portion, each have diamond cutting elements disposed in them.

Thus, when oriented in an operational position, a crowned nose of the pilot portion forms the lowermost extended cutting surface with a longitudinally extending inner gage defining the core diameter and radially spaced from the inner gage is a longitudinally extending pilot gage joining the pilot portion with the flank portion. The longitudinal length of the pilot portion, as formed by the pilot gage, extends far enough away from the flank portion so that the stresses and cutting action of the crowned nose of the pilot portion is substantially unaffected by the stresses and cutting action of the flank portion. The flank portion slopes radially outward from the pilot gage and joins through the smooth transition provided by the shoulder portion with the outer gage. By this form, the coring bit is able to cut core samples in highly fractured rock formations without disturbing material as the core sample is being cut and without dislocating the fractured segments within the core sample as the core is formed.

These and other aspects of the invention are best understood by now viewing the following Figures in light of the detailed description

DETAILED DESCRIPTION OF THE PREFERRED EMBODIMENTS

The present invention is an improved rotating coring bit incorporating diamond cutting elements wherein a pilot is provided as an extended cylindrical cutting body to define the inner gage of the bit and to cut the core with a minimum of formation disturbance. More specifically, the coring bit is shaped to include a longitudinally extending, relatively radially thin cylindrical pilot which is concentric with and which defines the inner gage of the bit or the core diameter. Cylindrical polycrystalline diamond (PCD) elements are axially disposed into the crowned face of the pilot nose portion of the bit to provide the cutting action for the core. Longitudinally displaced from the pilot nose portion is a 15° sloping flank, also provided with PCD elements. The sloping flank extends from the outer diameter of the pilot to the shoulder of the bit. The shoulder of the bit in turn provides a transition from the flank to the outer gage of the bit. As with the pilot and flank, the shoulder and outer gage are each provided with a plurality of diamond cutting elements disposed in a pattern described in greater detail in connection with the Figures as set forth below.

Figure 1:
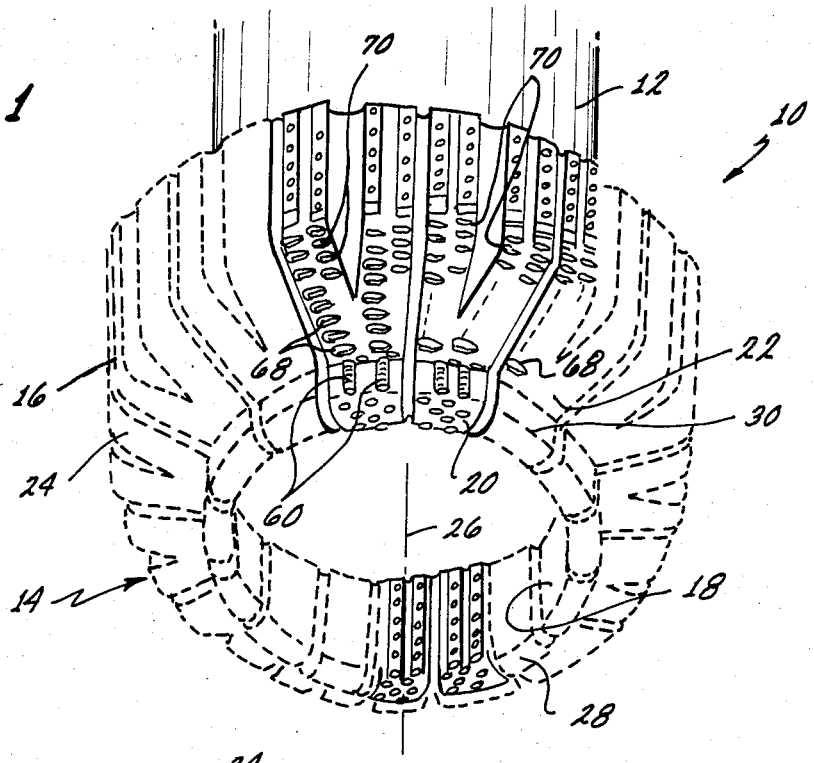
FIG. 1 is a pictorial illustration of a coring bit incorporating the invention.

Consider first the pictorial perspective shown in FIG. 1. The rotating diamond bit generally denoted by reference numeral 10, is characterized by a shank 12 and a bit face, generally denoted by reference numeral 14. Bit 10 is formed by infiltration molding techniques well known to the art or by other equivalent conventional means. Bit face 14 in turn includes in the coring bit illustrated in FIG. 1 as including an outer gage 16 defining the diameter of the bore hole, a concentric inner gage 18, a pilot portion 20, flank portion 22 and shoulder portion 24.

Beginning from the inner gage and moving outwardly, inner gage 18 forms a generally cylindrical surface about longitudinal axis 26 of bit 10. Inner gage 18 is contiguous and integral with pilot portion 20 which radially extends outwardly from inner gage 18 to form a crowned surface 28 better illustrated in FIG. 3. Crowned surface 28 is generally radial and as described below forms the principal cutting surface of pilot portion 20 for the formation of the cut core. Crowned face 28 is integral and contiguous with a pilot gage 30 forming the outer circular cylindrical surface of pilot portion 20. Pilot gage 30 extends in the longitudinal direction (parallel to longitudinal axis 26) and is integral and contiguous to flank portion 22. Again as better illustrated in FIG. 3, flank portion 22 forms a sloping surface at approximately 15° with respect to an imaginary radial plane 32, transverse to longitudinal axis 26. Sloping flank portion 22 continues radially outward and is contiguous and integral with shoulder portion 24 which provides a smooth curved transition to the cylindrical longitudinal surface of outer gage 16.

Inner gage 18, pilot portion 20, flank 22, shoulder 24 and outer gage 16 are each provided with a plurality of diamond cutting elements disposed on pads defined in turn by a plurality of alternating waterways 32 and collectors 34 in a manner described in greater detail below in connection with FIGS. 2–4.

Figure 2:
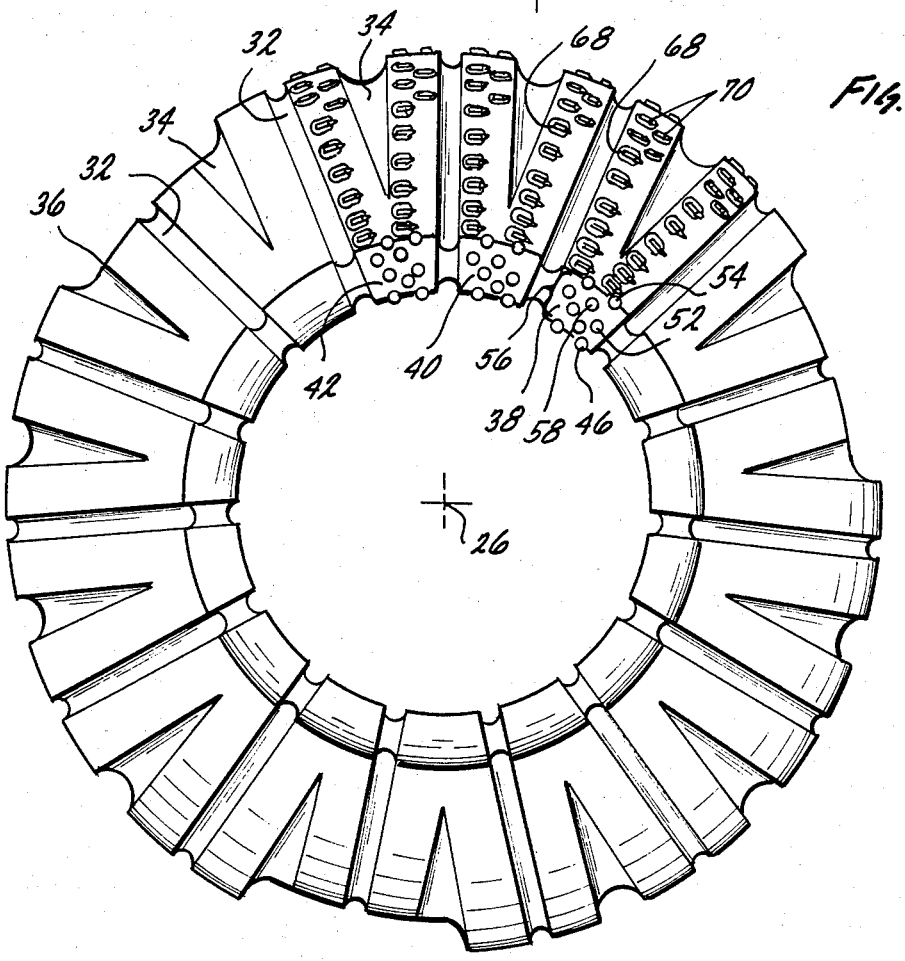
FIG. 2 is a plan diagrammatic view of the coring bit shown in perspective in FIG. 1.
Figure 3:
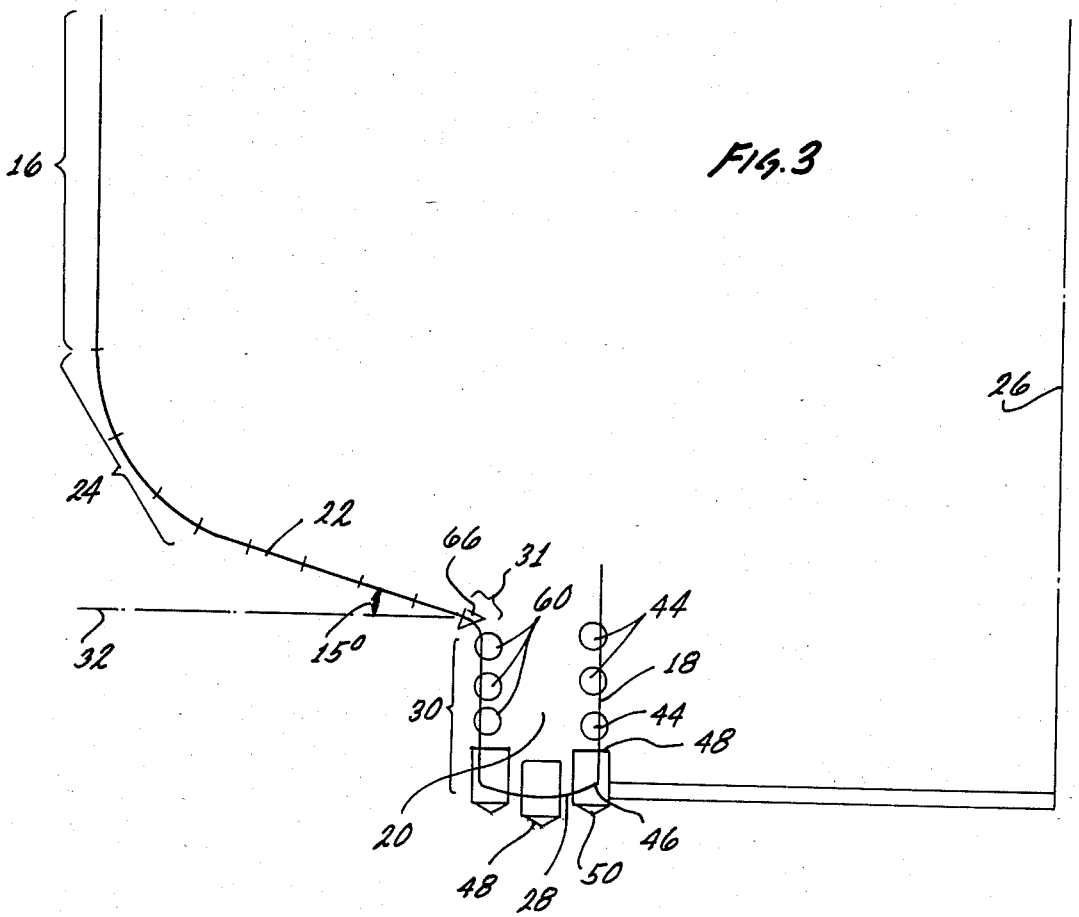
FIG. 3 is a half profile view showing the profile of the bit taken through line 3—3 of FIG. 2.

Thus as shown in perspective view in FIG. 1 and in sectional view in FIG. 3 taken through line 3—3 of FIG. 2, bit 10 is provided with a circular cylindrical extending pilot 20 provided on all surfaces with diamond cutting elements for the purpose of cutting a core in highly fractured rock formation in a manner to disturb the fracture planes and the core material thus cut to a minimal extent. In the preferred embodiment, the radial width of pilot portion 20, or more particularly the radial width of crowned face 28, is approximately 0.5 inch (1.27 cm) in a drill bit 10 of 8½ inch diameter (21.59 cm) with a 4 inch diameter (10.16 cm) inner gage. More simply stated, bit 10 is a 8½ inch diameter bit that cuts a 4 inch core. Pilot gage 30 as described above is contiguous and integral with flank 22. Flank 22 intersects pilot gage 30 through a generally circular transition surface 31. The height of pilot portion 20 as measured from the center of crowned face 28 to a center point of transition surface 31 between flank 22 and pilot gage 30 is approximately ¾ of an inch (1.9 cm) in the illustrated embodiment.

Therefore, the 4 inch (10.2 cm) core is cut principally by crowned face 28 of pilot portion 20 across a cylindrical swath at the bottom of the bore hole, which cutting surface, when viewed in plan view along longitudinal axis 26, is seen as a cylindrical ring ½ inch (1.3 cm) in diameter. The grinding and cutting action of the main portion of the 8 inch bit does not commence in the rock formation until the rock formation contacts the longitudinally setback flank 22, shoulder 24 and outer gage 16. The cutting surface of the remaining portions of bit 10, namely flank 22 and shoulder 24 are seen in plan view along longitudinal axis 26 as a cylindrical ring of 6 inches (15.2 cm) in width. Therefore, the greater grinding and cutting forces and the higher stresses imparted to the rock formation by bit 10 are applied to the rock formation at a location within the bore hole at a significant distance from the situs of the cutting surface which defines the outer diameter of the 4 inch core being cut from the formation. In other words, because of the shape of the coring bit illustrated in FIGS. 1 and 3, the cutting surface forming the core is displaced in the rock formation at least ¾ to 1 inch (1.9–2.5 cm) longitudinally below the cutting surface defined by bit 10 for defining of the bore hole. In most fractured formations according to the invention, this distance is sufficient to remove any dislocating forces, and to prevent the introduction of ground debris into the core, which would otherwise prevent a clean or accurate core sample from being taken.

The cutting action of the invention as generally provided by the shape of bit face 14 acts in combination with a selected disposition of diamond cutting elements on bit face 14. Turn now to FIG. 2 which shows bits 10 in plan view. In the illustrated embodiment, bit 10 is comprised of five groups of three pads. Each pad is divided by a waterway 32 which runs up outer gage 16, across shoulder 24, along flank 22, up pilot gage 30, over crowned face 28 and down inner gage 18. Drilling fluid is provided to waterways 32 in a conventional manner for cooling, cleaning and lubricating bit face 14. A collector 34 is also defined between each waterway 32. Three equally spaced junk slots 36 are also defined in outer gage 16. The center of each junk slot 36 communicates with one of the waterways 32 which has the last quarter section of its length (across its flank 22) choked down or restricted by 50% in order to compensate for the lesser restriction to the flow of hydraulic fluid provided by junk slot 36. In other words, unless such a restriction were provided within the communicating waterway 32, hydraulic fluid would tend to be preferentially drawn along and toward those waterways 32 communicating with the fluid sinks provided by junk slots 36 as opposed to those waterways 32 which run radially outward to the full radius of outer gage 16. In the illustrated embodiment, each junk slot 36 also communicates at its azimuthal extremities with two succeeding collectors 34 which are designed with the same depth, curvature and shape as those other waterways 34 not in communication with a junk slot 36.

Consider for example now one group of three pads, namely pads 38, 40 and 42. Each of the five groups is substantially the same as the group including pads 38–42. Each pad, defined by consecutive waterways 32 begins on inner gage 18 as best illustrated in FIG. 1. Two rows of smaller diamonds are surface-set into inner gage 18 as shown in cross sectional view in FIG. 3. Generally, "surface-set" means that the diamond eelement is embedded into the surface of bit 10 without the provision of any specialized supporting tooth structure. In the illustrated embodiment, three natural diamonds 44 of 5 per carat size are set as kickers in two longitudinal rows spaced apart by approximately ¼ inch (0.635 cm). The two rows are symmetrically set within each pad, such as at one-third of the pad width from the next closest waterway 32. These surface-set diamonds 44 are set for a 0.025 inch (0.0635 cm) exposure and may be longitudinal oriented between rows so that one diamond or kicker 44 on inner gage 18 falls immediately behind a preceding kicker 44 on the preceding row.

Alternatively, the placement of diamonds within the gage rows of the inner gage 18 may be longitudinally offset one with respect to the other so that each kicker 44 falls in the half space between two adjacent kickers in the preceding row. In either case, each row of kickers 44 lead toward a diamond cutting element 46 set on crowned face 28 of pilot portion 20.

In the preferred embodiment, each of the diamond cutting elements on crowned face 28 include a generally axially set, full cylindrical PCD element. As illustrated in FIG. 3, these synthetic cylindrical PCD elements, such as element 46, are characterized by a flat base 48 and an opposing domed base 50. The longitudinal axis of cylindrical element 46 is set generally parallel to longitudinal axis 26 of bit 10 and element 46 in particular is set within crowned face 28 to radially extend therefrom toward inner gage 18 to be characterized by the same radial exposure into inner gage 18 into kickers 44. In other words, element 46 is axially set into the edge of crowned face 28 and extends therefrom to provide a radial exposure of 0.025 inch (0.0635 cm) from the surface of inner gage 18 toward longitudinal axis 26. The longitudinal exposure of element 46 is 0.105 inch (0.267 cm).

Continuing in a radial direction from element 46, the width of crowned face 28 is sufficient to allow the placement of two more identical cylindrical diamond cutting elements, namely, one element 48 set at the midpoint of crowned face 28 and a third element 54 set on the opposing edge of crowned face 28 and extending therefrom to form part of pilot gage 30 in substantially the same manner as element 46 radially extends from and forms part of inner gage 18. The other row of kickers on inner gage 18 for each pad similarly leads to a row of cylindrical PCD elements, collectively denoted by reference numeral 56, which row 56 is substantially identical to the row of diamond cutting elements represented by elements 46, 52 and 54. A third row 58 of cylindrical PCD elements are axially set into crowned face 28 between row 56 and the row comprised of elements 46, 52 and 54. Third row 58 in the illustrated embodiment includes two PCD elements radially offset with respect to row 56 so that the diamond cutting elements on row 58 are azimuthally shifted but radially aligned in the half-spaces behind to row 56 as best seen in plan view in FIG. 2.

Turning again to FIG. 3, pilot gage 30 is similarly provided with two rows of kickers 60 longitudinally aligned below diamond elements 54 and 62 on crowned face 28. As in the case with inner gage 18, kickers 60 are comprised of smaller rounded natural diamonds of 5 per carat size and surface set for a 0.025 inch (0.0635 cm) exposure. Kickers 60 in the two rows, best seen in FIG. 1 may be longitudinally aligned with corresponding kickers 60 in the adjacent row so that one kicker lies in the same longitudinal spacing on pilot gage 30 as the preceding kicker, or kickers 60 may be longitudinally offset as described above in connection with inner gage 18 so that each kicker lies in the half space behind the kickers in the preceding row.

In either case, each row of kickers 60 on pilot gage 30 terminates in a cutting element disposed in the center of the curved transition surface 31 between pilot gage 30 and flank portion 22. In the illustrated embodiment, diamond cutting element 66 disposed in transition surface 31 is a tangentially set triangular prismatic element surface-set for approximately 0.045 inch (0.114 cm) exposure. Such a prismatic triangular elements are manufactured by General Electric Co. under the trademark GEOSET 2102.

Turning again to the plan view of FIG. 2, it may be readily appreciated that each pad 38–42 is bifurcated by a collector 34 to form two radially extending bifurcated pads. Each bifurcated pad is generally parallel to the next adjacent bifurcated pad forming part of the adjacent pad. Thus, the walls of waterway 32 which separates the adjacent bifurcated pads on adjacent pads are generally parallel walls defined at a uniform spacing across flank 22 and shoulder 24. Collectors 34 have a triangular plan view with the azimuthal width of each collector 34 increasing as collector 34 extends radially outward toward outer gage 16.

The leading edge of each bifurcated pad is provided with a plurality of diamond cutting elements. Again, in the illustrated embodiment the diamond cutting elements provided across the length of each bifurcated pad from pilot gage 30 to and across shoulder 24 are tangentially set triangular prismatic diamond elements disposed within an integrally formed teardropped-shaped tooth 68 of the type described and claimed in greater detail in the copending application, Ser. No. 473,020, filed Mar. 7, 1983, now U.S. Pat. No. 4,491,188, assigned to the same assignee as the present invention. Again, each teardrop-shaped tooth includes a triangular prismatic tangentially set diamond element. In the preferred embodiment, the size of such diamond elements is varied although the exposure of each element is uniform among the teeth, namely 0.105 inch (0.267 cm). The larger and smaller sizes of triangular prismatic diamond elements are alternated within each radial row on each bifurcated pad. The larger diamonds are tangentially set synthetic diamonds manufactured by General Electric Company under the trademark GEOSET 2103, while the smaller diamonds are those manufactured under the trademark GEOSET 2102.

As stated above, a single row of such teeth 68 is provided from pilot gage 30 across flank portion 22 and shoulder portion 24 up to outer gage 16. However, a second row of teardrop-shaped teeth 70, each including a triangular prismatic shaped diamond element as described above, are set behind and in the half-spaces between the teeth in the preceding row on shoulder portion 24 on each bifurcated pad. Thus, on shoulder portion 24, where the linear cutting velocity is highest and where the greatest abuse and cutting action often occurs in the case of a rotating bit, a double row of diamond bearing teeth provide the cutting action.

Figure 4:
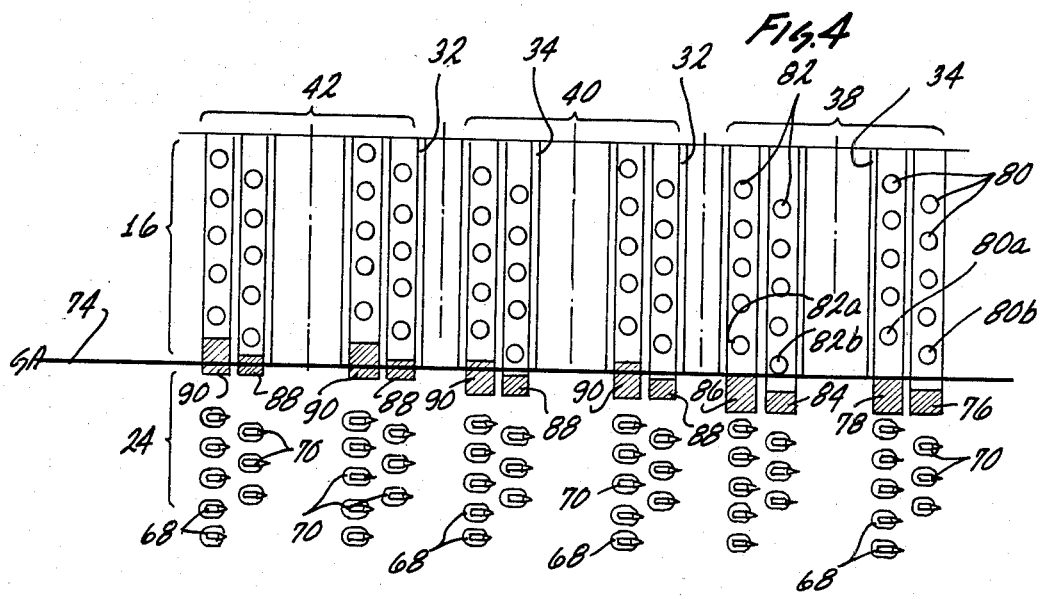
FIG. 4 is a diagrammatic plot of the cutting elements on the outer gage of the bit of FIGS. 1–3.

Turn now to FIG. 4 where the diamond plot for outer gage 16 of each of the pads 38–42 is laid out in a planar view. The double row of teeth 68 and 70 on shoulder portion 24 extend up to or close to outer gage 16. The circular cylindrical longitudinal surface of outer gage 16 is defined as beginning at gage line 74. The double row of teeth 68 and 70 stop at a predetermined distance away from gage line 74. The remaining distance within shoulder portion 24 between termination of rows 68 and 70 and gage line 74 are provided with a corresponding surface set diamond cutting element. For example, corresponding to second row 68 is a surface set GEOSET 2102, denoted by reference character 76, which is tangentially set in an inverted manner within shoulder portion 24 in a point down fashion so that the rectangular base is presented as the outermost surface of element 76. Similarly, element 78 corresponding to leading row 68 is a GEOSET 2103 diamond similarly surface set so that its exposed rectangular base forms the uppermost cutting surface on shoulder portion 24. Rows 68 and 70 are continued through elements 76 and 78 respectively to form two corresponding rows of kickers 80 along outer gage 16. The radial outermost edge of larger diamond elements 78 on pad 38 lies at gage line 74. A similar double row of kickers 82 on pad 38 are provided corresponding to the other one of the bifurcated pads included on pad 38 and are similarly provided with inverted surface set GEOSETS 84 and 86 corresponding respectively to elements 76 and 78.

Consider for the moment only pad 38 as illustrated in FIG. 4. In the preferred embodiment, kickers 80 and 82 form two pairs of row separated by a collector 34 extended down outer gage 16 with five kickers surface-set per longitudinal row. Again, in the illustrated embodiment kickers 80 and 82 are rounded natural diamonds of five per carat size set for a surface exposure of 0.045 inch. Kickers 80 and 82 forming the four rows are staggered one with respect to the other. For example, consider the unit spacing as defined by the distance from gage line 74 to the position of kicker 80*a*. For the purposes of this discussion, this distance shall be defined as a unit spacing, namely that distance between each adjacent kicker within a given longitudinal row. Kicker 80*b* is set at the one-half unit space between the unit space of kicker 80*a* and gage line 74. Thus, each kicker within the row of kicker 80*a* is set in the half-space relative to the kickers in the adjacent row in which the kicker 80*b* is set.

Consider now kickers 82 and the corresponding pair of longitudinal rows. Kicker 82*a* is set at the three-quarter point, namely one-quarter of unit space from the longitudinal level of kicker 80*a* and three-quarters of a unit space from gage line 74. Similarly, kicker 82*b* is set at the one-quarter point, namely three-quarters of a unit space below the longitudinal level of kicker 80*a* and one-quarter of the unit space above gage line 74. Thus, kickers 80*a, b* and 82*a, b* cut an azumuthal swath in the bore hold wherein a diamond element is presented at every longutinal line within the bore hole at each one-quarter unit spacing along outer gage 16.

Turn now to pad 40 as depicted in FIG. 4. As with pad 38, the kickers within pad 40 are similarly organized into two pairs of kicker rows. Each row begins as before with an inverted tangentially set PCD element, namely a GEOSET 2102 or 2103. For clarity, GEOSETS 2102 shall be denoted in pads 40 to 42 by reference numeral 88, while GEOSETS 2103 shall be denoted by reference numeral 90. The same unit spacing used among kickers 80 and 82 on pad 38 is similarly employed among the kickers within pads 40 and 42. Thus, pads 40 and 42 also present a diamond cutting element on outer gage 16 at each quarter unit spacing as the bit rotates. However, as shown in FIG. 4, the two pairs of kicker rows comprising pad 40 on outer gage 16 are offset with respect to the two pairs of kicker rows comprising pad 38 on gage 16 and similarly with respect to kicker rows of pad 42. Each group of four rows, comprising the kickers of pad 40 on one hand and the kickers of pad 42 on the other hand, are longitudinally offset one with respect to each other by one-third of a unit spacing along outer gage 16. In other words, kicker 92 on pad 40 is 1 and $\frac{1}{3}$ of a unit space from gage line 74. Similarly, kicker 94 on pad 42 is 1 and $\frac{2}{3}$ of a unit space from gage line 74. As a result, as pads 38–42 are rotated to cut an azimuthal swath, a kicker from one of the pads 38–42 will be presented at any given longitudinal line in the bore hole at each 1/12 of a unit space. The patterned segments as illustrated in FIG. 4 is replicated five times about the circumference of bit 10 as depicted in plan view in FIG. 2. This redundancy and staggered spacing thus provides a reliable and precision outer gage diameter for bit 10. Inner gage 18 could also be provided with such a staggered pattern if desired.

Many modifications and alternations may be made by those having ordinary skill in the art without departing from the spirit and scope of the invention. For example, although the illustrated embodiment has been described in the Figures in connection with specified dimensions, repititions and numbers of elements, it must be understood that the various chosen for these dimensions, repititions and numbers of elements can be altered according to teachings of the invention without departing from its scope. Thus, the height and width of pilot portion 20 may be increased or decreased as appropriate; and the configuration of cutting elements on crowned face 28 may be varied, as well as elsewhere on bit face 14, all without material departure from the teachings of the invention. Therefore the illustrated embodiment has been shown only for the purposes of example and clarification and must not be taken as limiting the invention as defined in the following claims.

We claim:

1. A rotating bit for coring including an inner gage of said bit defining a core diameter and an outer gage of said bit defining a bore diameter, said bit including a bit face having a longitudinal axis, said bit comprising:

a pilot portion extending from said inner gage in a radial direction and longitudinally extending from said bit face to form a generally cylindrical cutting section, said pilot portion having diamond cutting elements disposed therein;

a flank portion extending from said pilot nose portion, said flank portion characterized by a predetermined slope defined with respect to said longitudinal axis of said bit, said flank portion having diamond cutting elements disposed therein; and a shoulder portion extending from said flank portion to said outer gage to smoothly join said flank portion to said outer gage, said shoulder portion having diamond cutting elements disposed therein, wherein said flank portion joins said pilot portion through a smoothed transition surface, said transition surface having an exposed diamond cutting element disposed therein, whereby a rotating bit for coring is devised which minimizes disturbance to said core while cutting and minimizes jamming of said core.

2. The bit of claim 1 wherein said exposed diamond cutting element is disposed in the center of said transition surface and includes a PCD element.

3. The bit of claim 2 wherein said PCD element disposed in said transition surface is an exposed triangular prismatic element tangentially disposed therein.

* * * * *